US006386171B1

(12) United States Patent
Koerner et al.

(10) Patent No.: US 6,386,171 B1
(45) Date of Patent: May 14, 2002

(54) OIL DELIVERY SYSTEM WITH OIL TEMPERATURE COMPENSATION CONTROL

(75) Inventors: Scott A. Koerner, Kenosha, WI (US); Anteo C. Opipari, Chicago, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/689,375

(22) Filed: Oct. 12, 2000

(51) Int. Cl.[7] ..... F02B 33/04
(52) U.S. Cl. ..... 123/196 R
(58) Field of Search ..... 123/196 R, 196 A, 123/196 M, 196 S, 73 AD; 184/6.8

(56) References Cited

U.S. PATENT DOCUMENTS 5,067,454 A * 11/1991 Waddington et al. .... 123/196 S
5,355,851 A * 10/1994 Kamiya ..... 123/196 R
5,921,758 A * 7/1999 Anamoto et al. ..... 123/196 R
6,283,072 B1 * 9/2001 Lavy et al. ..... 123/196 R

* cited by examiner

*Primary Examiner*—Marguerite McMahon
(74) *Attorney, Agent, or Firm*—Timothy J. Ziolkowski; Cook & Franke SC

(57) ABSTRACT

An oil temperature compensation control is disclosed for use with an oil delivery system in an outboard marine engine. The control includes an oil injection system that normally routes lubricant through a closed loop, and periodically diverts lubricant to the engine. The control includes a temperature sensor to acquire an oil temperature indicative signal, which preferably, is an indirect measurement of oil temperature. The control includes a microprocessor connected to receive the oil temperature indicative signal, and in response thereto, to control the period lubricant is routed to the engine by the oil injection system. The microprocessor includes a memory to store a look-up table that includes a solenoid pulse width for a variety of temperature signals so that the solenoid can be toggled based on the viscosity of the oil to provide proper lubrication to the engine regardless of external temperatures.

26 Claims, 10 Drawing Sheets

FIG. 1
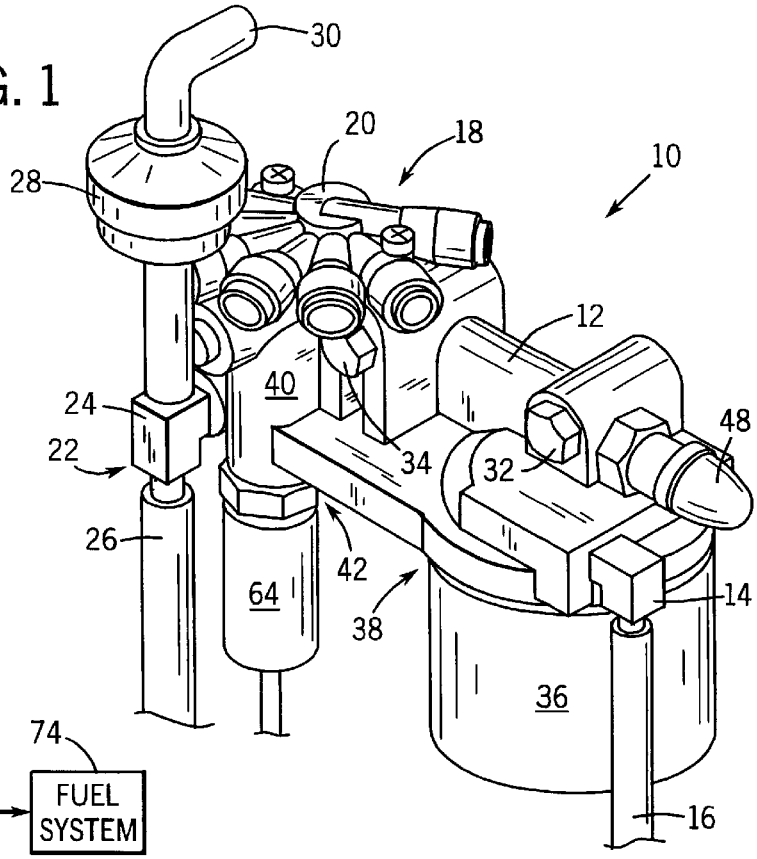
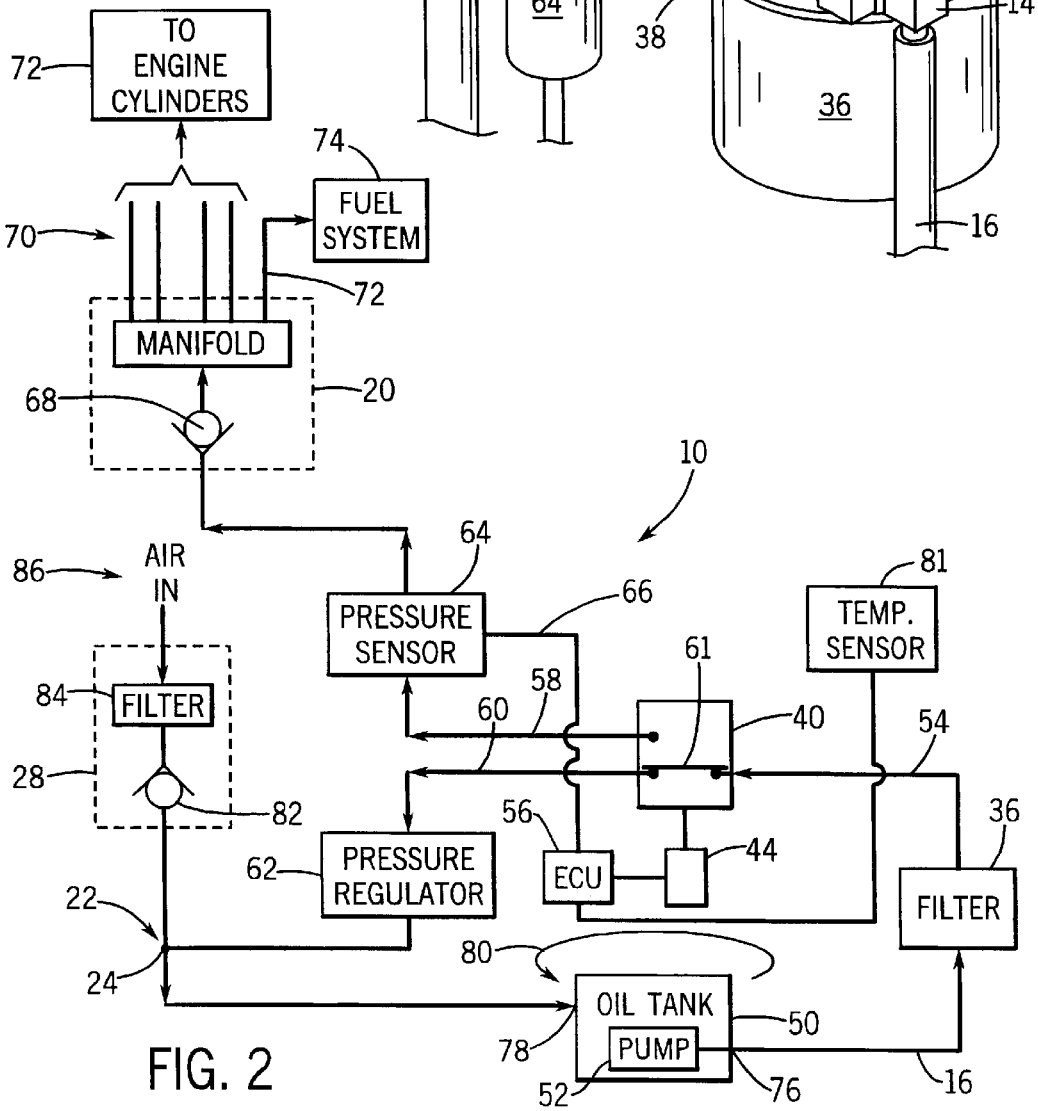
FIG. 2

OIL DELIVERY SYSTEM WITH OIL TEMPERATURE COMPENSATION CONTROL

BACKGROUND OF THE INVENTION

The present invention relates generally to oiling systems for internal combustion engines, and more specifically, to a temperature control to vary oil delivery to a two-cycle/two-stroke engine of an outboard motor.

Typically, two-stroke outboard marine engines do not have a separate oiling system. That is, these prior art engines require pre-mixing lubricant and fuel so that the lubricant dissolves in the fuel to lubricate the engine. This requires consistent, accurate measuring and agitation of the mixture. There are many disadvantages to the prior art system of pre-mixing lubricant and fuel. For example, since various two-stroke engines require different mix concentrations, many outboard marine engine owners also own other two-stroke engine equipment, such as various lawn and garden equipment and ATV's, they may store several different concentrations of oil/fuel mixture. This is not only an aggravation to the owner, but is also problematic if the containers become mixed up and the owner uses the wrong concentration for a particular two-stroke engine. While this is not catastrophic, if run over time with the wrong concentration, a two-stroke engine can wear excessively.

The present invention is for use in a unique lubrication system for two-stroke engines. Such a lubrication system must not only provide lubrication to each cylinder of the engine, it must also provide lubrication to the fuel system to properly lubricate the fuel metering and injection system.

Two-stroke engines are used in a variety of applications under many different temperature conditions. Current oiling systems for two-stroke engines do not provide temperature compensation for the delivery, of oil as the temperature of the oil changes. Since the viscosity of oil increases with decreasing temperature, without any compensation, oil delivery to the engine can decrease resulting in insufficient oil delivery and the potential of serious engine damage. Conversely, as temperature of oil increases, the viscosity of the oil decreases. Without proper compensation, such a decrease in the viscosity of the oil can result in an increased amount of oil delivered to the engine resulting in excess oil consumption and engine smoking.

It would therefore be advantageous to provide temperature compensation control in an oiling system for a two-stroke engine to modify oil delivery based on the viscosity of the oil.

SUMMARY OF THE INVENTION

The present invention discloses an oil temperature compensation control for use in an oil delivery system for a two-stroke engine that solves the aforementioned problems.

In accordance with one aspect of the invention, a temperature compensation control for an oiling system includes an oil injection system that periodically routes lubricant to an engine and a temperature sensor to acquire an oil temperature indicative signal. A microprocessor is connected to receive the oil temperature indicative signal from the temperature sensor, and in response thereto, controls the time period lubricant is routed to the engine by the oil injection system in order to compensate for the viscosity of the oil for various temperatures.

In accordance with another aspect of the invention, an outboard motor having an internal combustion engine and an oiling system to distribute oil to the internal combustion engine is disclosed. The oiling system has a closed loop re-circulation system that includes a remotely located oil reservoir. The oiling system also includes an oil flow control section that periodically diverts lubricant to the internal combustion engine. A temperature sensor is provided to acquire a temperature signal having a relationship to the viscosity of the lubricant in the remotely located oil reservoir. The outboard motor includes a control to receive and process the temperature signal from the temperature sensor, and then to adjust the period that lubricant is diverted to the internal combustion engine in response to the temperature signal to compensate for viscosity changes in the lubricant.

The invention also includes a method of providing lubricant to a two-stroke engine that includes acquiring a temperature signal that is indicative of the temperature of a lubricant supply and correlating the temperature signal to a viscosity of the lubricant. The method next includes adjusting lubricant flow to the two-stroke engine based on the viscosity of the lubricant.

The invention includes a computer program that causes a computer to periodically acquire a temperature signal that is indicative of the lubricant temperature and then adjusts lubricant flow to an engine in an outboard motor based on the lubricant's viscosity. The temperature signal acquired can be that of ambient temperature of the outboard motor that is then correlated to oil viscosity and converted to a pulse width signal to control a solenoid that in turn controls lubricant flow to the outboard motor.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings:

FIG. 1 is a perspective view of an oiling system for a two-stroke outboard marine engine.

FIG. 2 is a schematic illustration of an oiling system in accordance with one aspect of the present invention.

DETAILED DESCRIPTION OF THE PREFERRED EMBODIMENT

Figure 3:
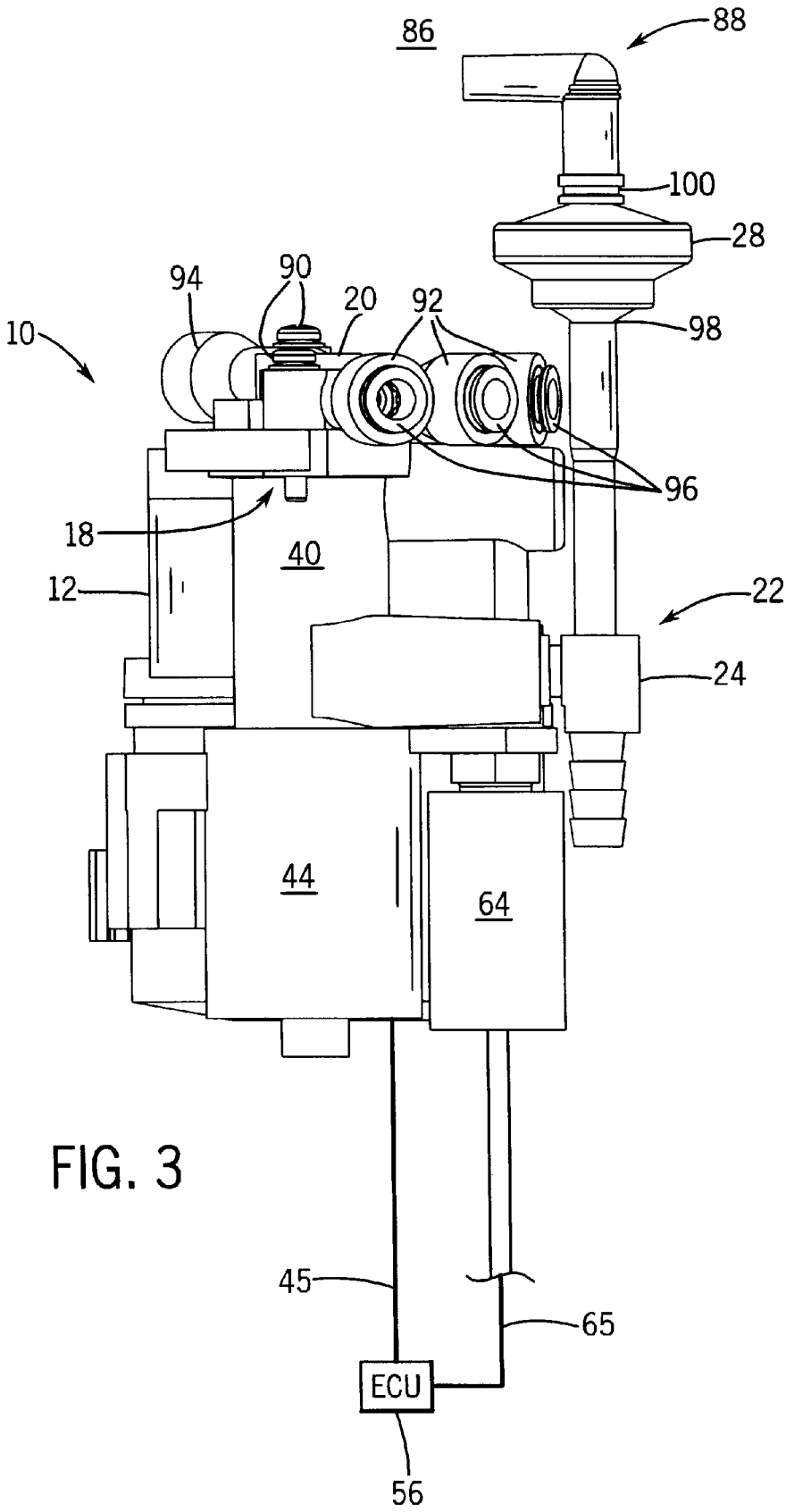
FIG. 3 is a left side, elevational view of the oiling system of FIG. 1 connected to an ECU of an outboard motor.

Referring to FIG. 1, an oiling system 10 is shown, preferably for a two-stroke engine of an outboard marine motor. The oiling system 10 includes an oil system housing 12 having an oil inlet 14 connected to a supply line 16. The oiling system housing 12 also includes an oil outlet 18 that supplies oil to a distribution manifold 20. A separate oil return 22 is provided through a tee-connector 24 connected to the oil system housing 12 and a return line 26 to return unused oil to an oil reservoir. The tee-connector is also connected to a vent valve 28 that is open on one end 30 to atmospheric pressure.

The oil system housing 12 is mounted to an engine with mounting bolts 32, 34 and is constructed to receive a full flow, replaceable oil filter 36 on an oil filter base 38 to filter incoming pressurized oil from supply line 16 through oil inlet 14. The pressurized oil is then routed through internal passages to an oil flow control section 40 of the oil system housing 12. The oil flow control section 40 is controlled by a solenoid (not shown in FIG. 1) that controls whether oil flows through the oil outlet 18 and distribution manifold 20 or through the oil return 22 and return line 26. The oil system housing 12 also includes a test port 48 that is in fluid communication with an output side of the replaceable oil filter 36 to measure oil pressure during operating conditions. The housing 12 also includes a sensor chamber 42 to receive an oil pressure sensor 64 therein.

Referring to FIG. 2, a schematic representation of an oiling system 10 in accordance with the present invention is illustrated. The oil system includes an oil tank/reservoir 50 having an oil pump 52 associated therewith to pump oil through supply line 16 and filter 36. In a preferred embodiment, as shown in FIG. 2, the oil pump 52 is located inside the oil tank 50. After the oil is filtered, it is routed through an internal passage 54 of the oil system housing 12 to the oil flow control section 40 wherein the flow of oil is controlled by operation of solenoid 44, which in turn is controlled by an electronic control unit (ECU) 56. As previously indicated, the solenoid 44 toggles the flow of lubricant from internal passage 54 to internal passages 58 and 60. When the solenoid 44 is not activated, the normally open position 61 relays oil from the internal passage 54 to the internal passage 60 of the oil system housing 12 through an internal pressure regulator 62 and returns unused oil to the oil reservoir 50.

When solenoid 44 is activated, the flow of oil is diverted to internal passage 58 to supply oil to the distribution manifold 20. A pressure sensor 64 is in fluid communication with the lubricant in internal passage 58 to monitor the lubricant pressure and provide an oil pressure signal 66 to the ECU 56. The distribution manifold 20 includes an internal check valve 68 to prevent the backflow of oil in the oil system 10. The distribution manifold 20 has a number of cylinder oiling outlets 70 that coincide with a number of cylinders of an engine 72, and each oiling outlet 70 is connected to a cylinder of engine 72. The distribution manifold 20 also includes a fuel system oiling outlet 72 to supply lubricant to the fuel system 74, preferably, to lubricate a fuel injection distribution system, and purge air from the oil system through a fuel separator in the fuel system 74.

The oil reservoir 50 of oil system 10 includes an oil supply outlet 76 and an oil supply return 78 and is free of any internal ventilation mechanism. In this manner, the oil reservoir 50 can be completely submerged in water, and as long as the fill cap is properly closed, water cannot enter the oil reservoir.

When solenoid 44 is not activated, a closed loop 80 is formed in the oil routing system between the ventless oil reservoir 50, the filter 36, the oil flow control section 40, through internal passage 60, and the oil return 22. As long as no oil is withdrawn from the reservoir, by the activation of solenoid 44, the oil circulates through the closed loop 80. However, when the loop is open by solenoid 44 to divert lubricant from internal passage 60 to internal passage 58 in the oil flow control section 40, oil is then consumed in the engine 72 and the fuel system 74. This consumption of oil must be displaced or the oil reservoir 50 will come under an increasing negative pressure. Accordingly, the vent valve 28 is coupled to the closed loop 80 at one end of the tee-connector 24 at the oil return 22. Vent valve 28 is a vacuum controlled vent valve and includes a check valve 82 that preferably opens at approximately 3" of $H_2O$ to allow air to displace the consumed oil in the oil reservoir 50 when the solenoid valve 44 periodically diverts lubricant to engine 72. The vent valve 28 also includes a filter 84 to filter contaminates that may be drawn from the atmosphere 86.

The ECU 56 also includes a temperature compensation control algorithm, as will be described with reference to FIG. 13, for the oiling system 10. A temperature sensor 81 is provided to acquire an oil temperature indicative signal. The processor, in the ECU 56, is connected to receive the oil temperature indicative signal and in response thereto, to control the period lubricant is routed to the engine 72 via the solenoid 44 and the oil flow control section 40. Temperature sensor 81 is preferably remote from direct contact with the lubricant. For example, in one embodiment, in which fuel system 74 includes fuel injection system, the temperature sensor 81 can be an existing air temperature sensor on the intake to the engine. In another embodiment, where the fuel system 74 includes a carburetor, a thermistor can be used as the temperature sensor 81. In either case, a look-up table is developed for storage in memory of the ECU 56 based on measurements taken to correlate the readings from the remote temperature sensor 81 to the oil temperature in the oil system 10. A graph of oil temperature versus temperature at the remote temperature sensor 81 is then created and a least squares linear approximation of this data is used in the look-up table to correlate lubricant temperature from the oil temperature indicative signal of the temperature sensor 81. The ECU 56 then creates an oil viscosity control signal to control solenoid 44. In this manner, the time period lubricant is routed to the engine 72 through internal passage 58 is lengthened when lubricant temperature is low, and shortened when lubricant temperature is high for consistent lubrication regardless of external temperature. Alternatively, the temperature sensor 81 could be an oil temperature sensor in direct contact with the oil to obtain an oil temperature that can be used in the ECU 56 to control solenoid 44. In this case, the look-up table may be eliminated in favor of on-the-fly pulse width determination.

Referring to FIG. 3, a left side view of the oil system 10 and the oil system housing 12 of FIG. 1 shows the ventilation system 88, the distribution manifold 20, and the solenoid 44 and the pressure sensor 64 connected to the ECU 56 by lead wires 45, 65. The distribution manifold 20 is mounted to the housing 12 over the oil outlet 18 by mounting bolts 90. When oil is diverted by solenoid 44, it is routed through oil outlet 18 to a plurality of cylinder outlet housings 92 and a fuel system oiling outlet housing 94, each of which is equipped with a push-to-connect fitting 96 to allow quick connection and disconnection of the oiling lines that extend to each cylinder and the fuel system. As is indicated in FIG. 3, the fuel system oiling outlet housing 94 is at a higher elevation than each of the cylinder oiling outlets 92 to purge any air from the oiling system through a fuel separator in the fuel system.

The ventilation system 88 preferably includes a diaphragm vent valve 28. The vent valve 28 includes two ends 98, 100, wherein a first end 98 is in communication with the oil return 22 via the tee-connector 24 of the oil system housing 12. The second end 100 is open to the atmosphere 86 to draw air therefrom when solenoid 44 is activated by ECU 56.

Figure 4:
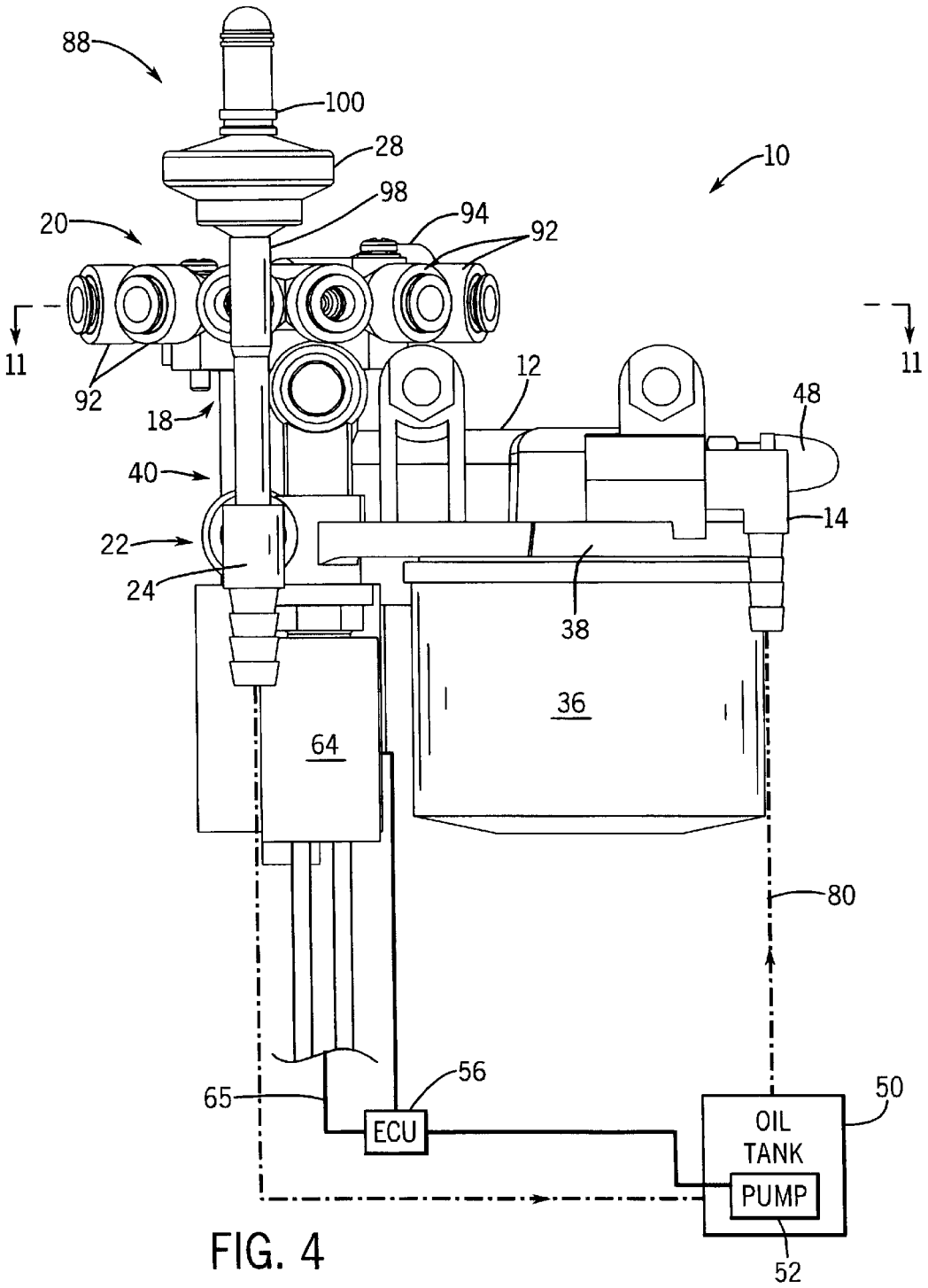
FIG. 4 is a front elevational view of the oiling system of FIG. 1 connected to an ECU and oil tank for an outboard motor.

FIG. 4 shows a front elevational view of the oiling system 10 of FIG. 1 connected schematically to the closed loop default flow path 80. As indicated, lubricant is pumped from the oil reservoir 50 by pump 52 and circulates through the closed loop system 80 all the while that solenoid 44 is not activated by the ECU 56, which also controls the oil pump 52. In this manner, oil is circulated from the oil reservoir 50 through the oil inlet 14, through the replaceable oil filter 36 and is routed in the oil flow control section 40 to the oil return 22, out the tee-connector 24, and back to the oil reservoir 50. When the solenoid 44 is activated by the ECU 56, oil is then diverted from the oil return 22 to the oil outlet 18 and out the distribution manifold 20 to each of the engine cylinders and the fuel system. As oil is consumed, the oil reservoir comes under a negative pressure and draws air through the ventilation system 88.

According to one aspect of the invention, the aforementioned system is incorporated into a two-stroke engine of an outboard motor that includes the oil system housing 12 having an oil filter base to replaceably receive an oil filter 36 thereon such that lubricant in the closed loop system 80 can be continuously filtered, and filtered before consumption by the two-stroke engine.

Figure 5:
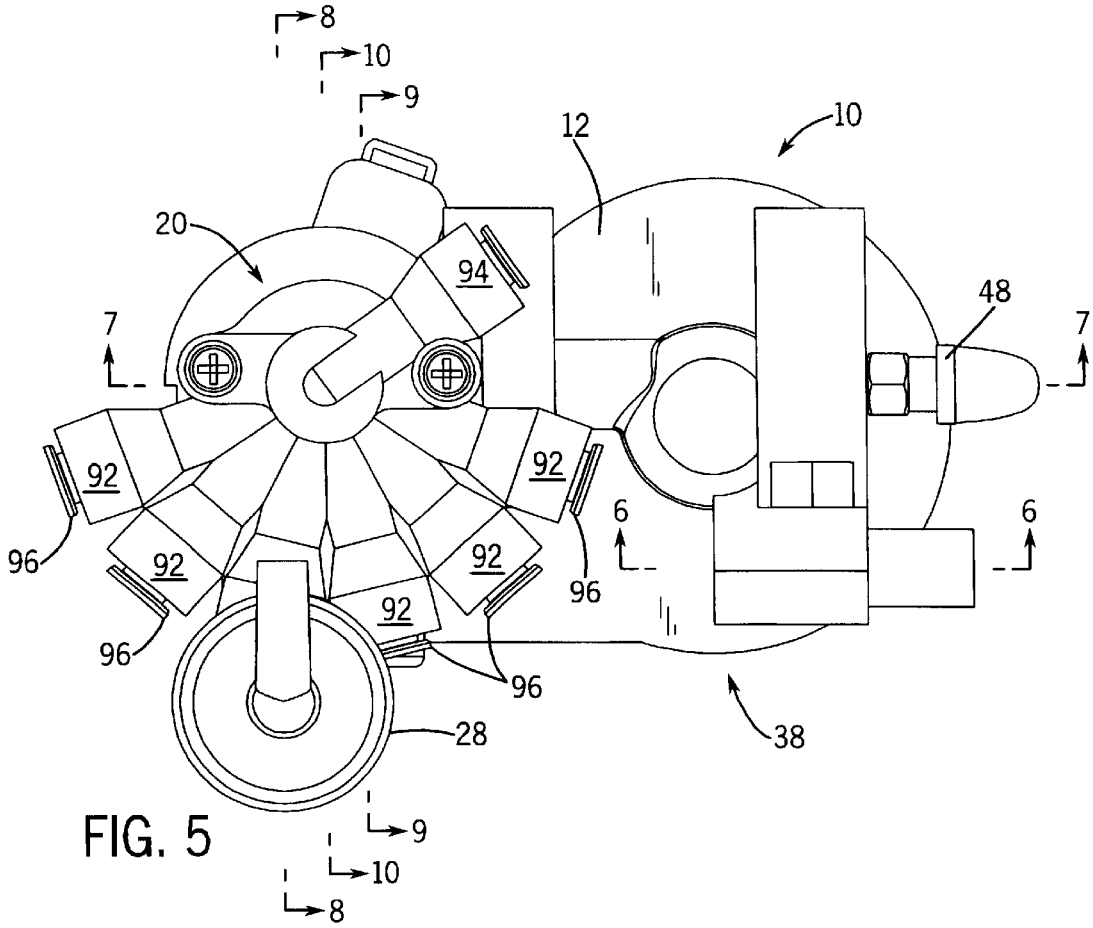
FIG. 5 is a top plan view of the oiling system of FIG. 4.

FIG. 5 shows a top plan view of the oiling system 10 of FIGS. 1, 3 and 4. FIG. 5 shows a top view of the distribution manifold 20 and the diaphragm vent valve 28. FIG. 5 is used to illustrate the cross-section views for FIGS. 6–10 that illustrate the oil flow paths through housing 12.

Figure 6:
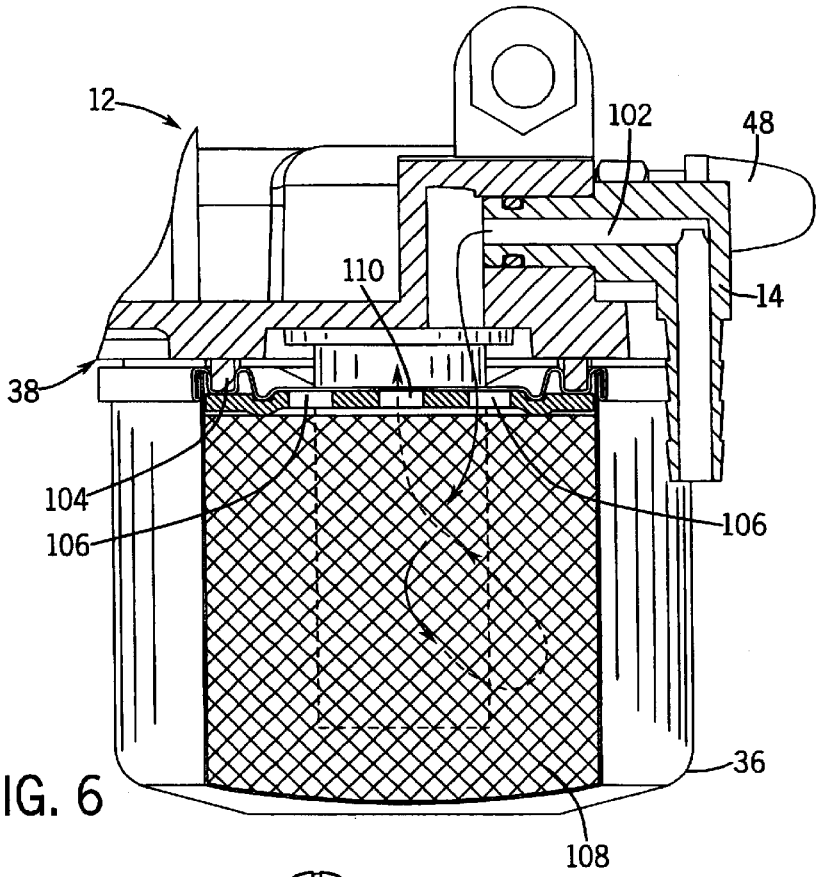
FIG. 6 is a partial cross-section of the oiling system taken along line 6—6 of FIG. 5.
Figure 7:
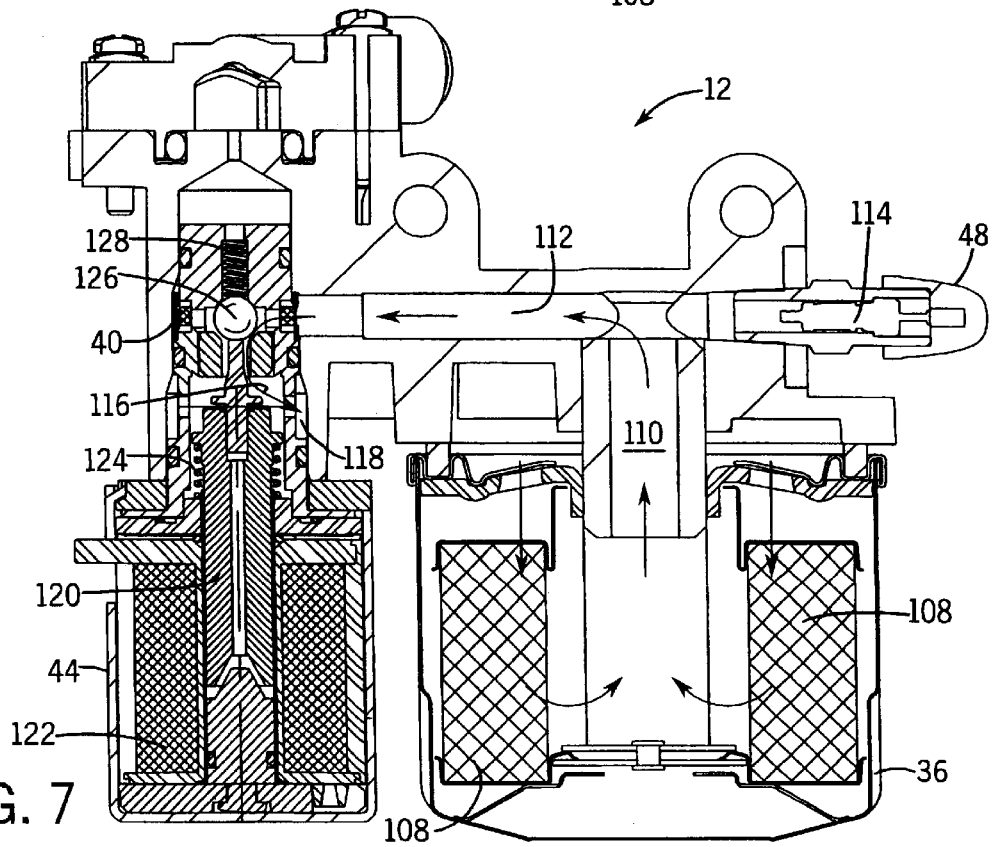
FIG. 7 is a cross-sectional view taken along line 7—7 of FIG. 5.

Referring to FIG. 6, oil is first introduced into the oil inlet port 14 through a first internal passage 102 and is then introduced into the full flow, replaceable oil filter 36. The oil filter is mounted to the oil filter base 38 and sealed therebetween with gasket 104. Oil is introduced into filter 36 through a plurality of openings 106, is filtered in element 108 and discharged through center opening 110. As shown in FIG. 7, once discharged through center opening 110, the oil enters a second internal passage 112 and is routed to the oil flow control section 40.

The test port 48 is in fluid communication with the second internal passage 112 and is equipped with a Schraeder valve 114 to test the oil pressure on the back side of filter 36. The Schraeder valve 114 thus provides an accurate reading of the oil pressure as it is presented through the system. If the oil pressure is low at this point, the first step is to replace the oil filter and recheck the oil pressure.

As indicated by arrow 116, oil is then routed to a third internal passage 118 when solenoid 44 is not activated. Solenoid 44 includes an internal plunger 120, magnet 122 and return spring 124 and is constructed in a known manner. The oil flow control section 40 includes a check ball 126 and a pressure spring 128 which moves downwardly when the solenoid is activated, which pulls plunger 124 downwardly and closes the oil path indicated by arrow 116 when oil is diverted to the engine.

Figure 8:
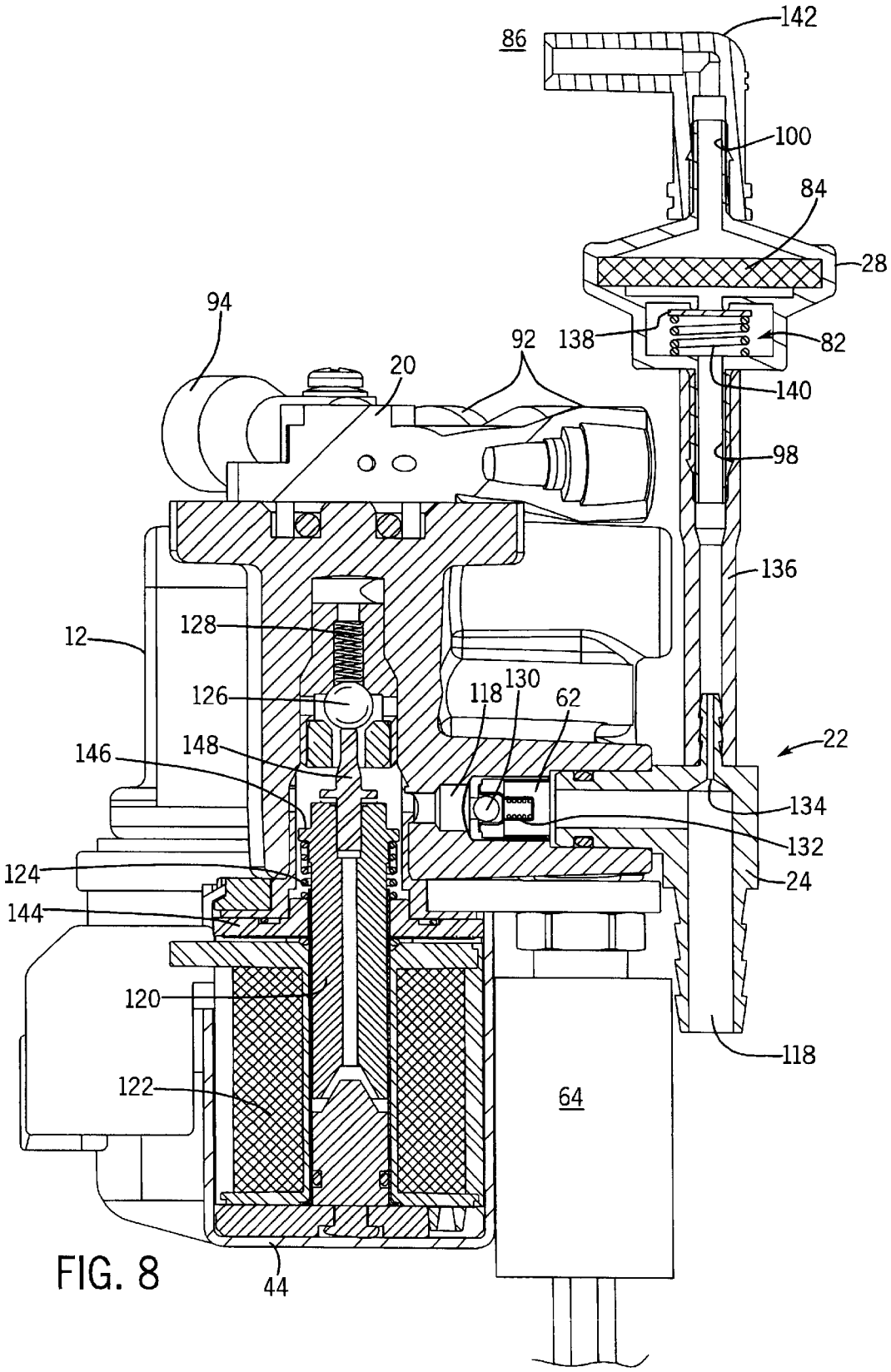
FIG. 8 is a partial cross-sectional view taken along 8—8 of FIG. 5.

Referring now to FIG. 8, the return oil path through solenoid 44 is shown. The oil return port 22, which includes the tee-connector 24, is in fluid communication with the third internal passage 118 through a pressure regulator 62. The pressure regulator 62 includes a check ball 130 and pressure spring 132 to regulate the oil pressure in the oil system at a desired level. The tee-connector 24 includes a relatively narrow air inlet passage 134 that is connected with a hose 136 to the vent valve 28. The vent valve 28 includes air filter 84 and check valve 82, which in turn includes a diaphragm 138 and return spring 140. The vent valve 28 is connected to an L-shaped extension hose 142 at its second end 100 to draw air from the atmosphere 86 to displace consumed oil, as previously described. FIG. 8 also shows a more detailed view of solenoid 44 in which plunger 120 is drawn downward when the magnet 122 is energized. The return spring 124, which is positioned between a stationary block 144 and a shoulder 146 of the plunger 120, causes the plunger to return to its upward position when the magnet 122 is de-energized. An extension shaft 148 is positioned within the plunger 120 and extends upward to support the check ball 126 against pressure spring 128 to maintain oil flow around the check ball 126 along the third internal passage 118.

Figure 9:
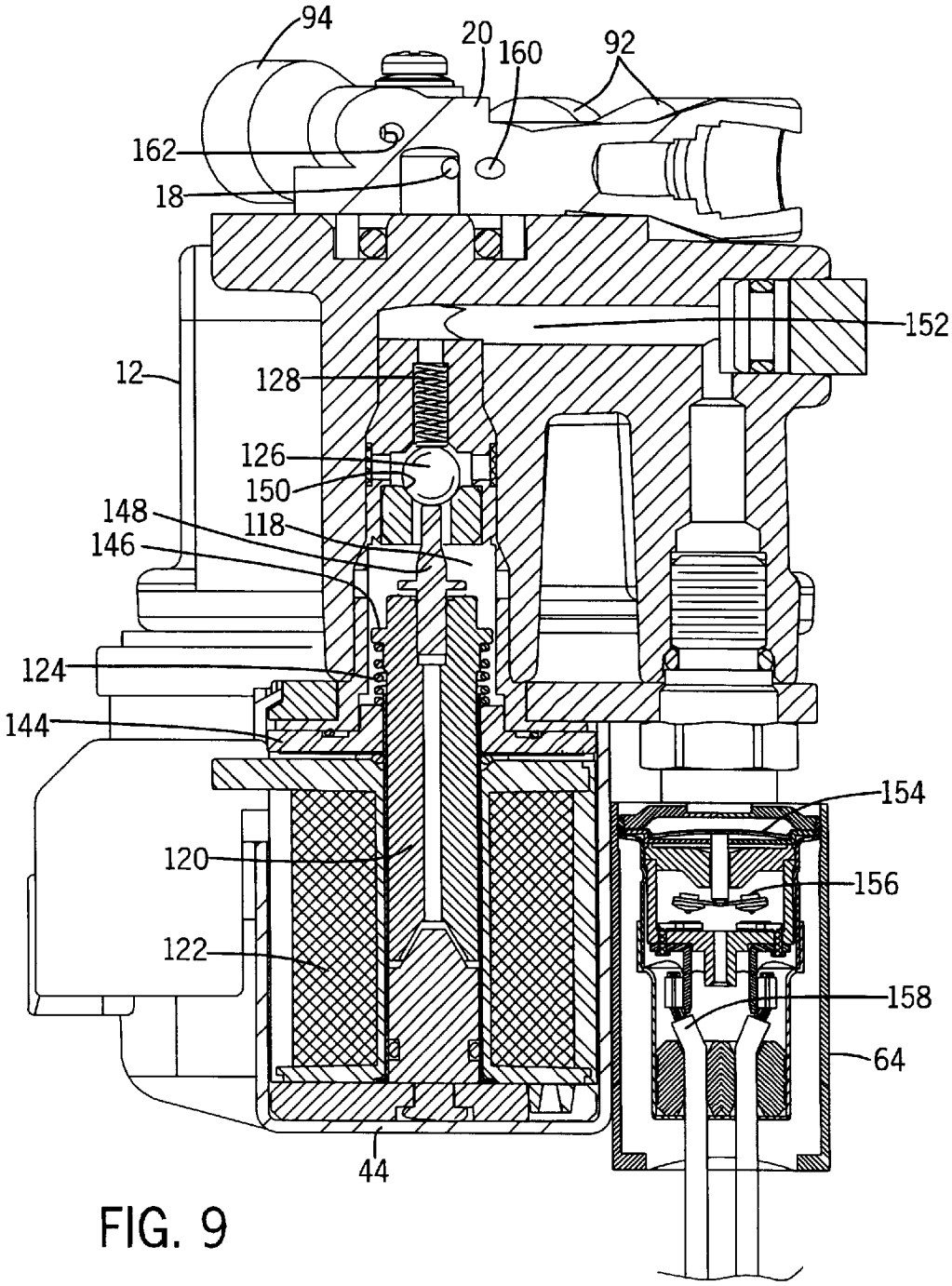
FIG. 9 is a partial cross-sectional view taken along line 9—9 of FIG. 5.
Figure 10:
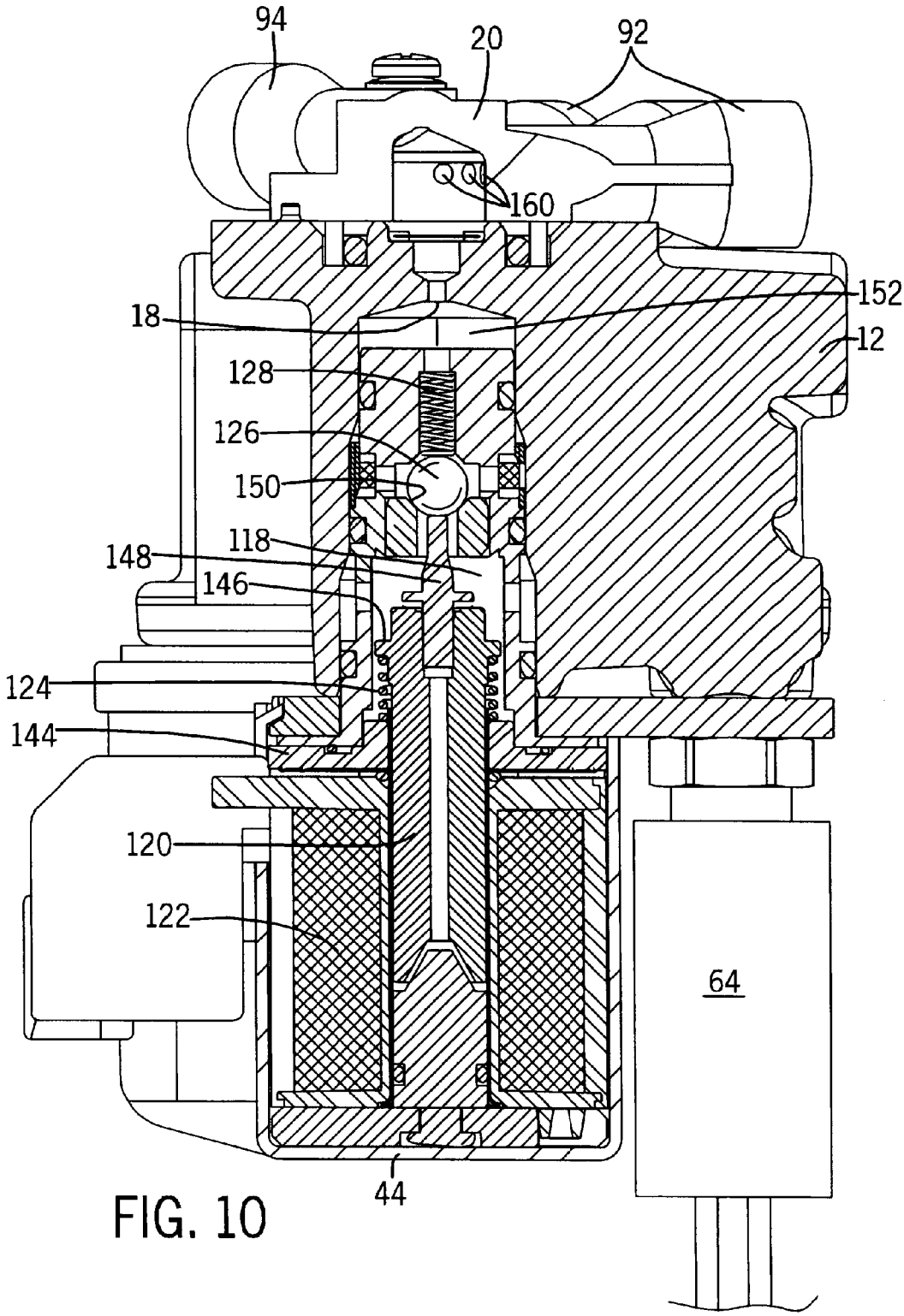
FIG. 10 is a partial cross-sectional view taken along line 10—10 of FIG. 5.

FIG. 9 shows the solenoid 44 in its actuated position with the plunger 120 drawn downwardly within the magnet 122. In this position, the return spring 124 is compressed and the pressure spring 128 is extended causing the check ball 126 against seat 150 which closes oil flow through the third internal passage 118. In this position, oil is routed through a fourth internal passage 152, which is in communication with the pressure sensor 64. Pressure sensor 64 is threadedly engaged in housing 12 and is constructed in a known manner having a pressure diaphragm 154 connected to a pair of contacts 156 that operate to close an electrical path between contact leads 158 which are connected to the ECU. The fourth internal passage 152 is also in fluid communication with the oil outlet 18 of FIG. 10 to supply oil to a number of passages 160 in the distribution manifold 20 to supply oil to the cylinder outlet housings 92 and then to each cylinder of the two-stroke engine. Oil is also supplied by oil outlet 18 to passage 162, FIG. 9, to supply oil through the fuel system oiling outlet housing 94 which leads to the fuel system. Internal passage 162 is at the highest point to purge any air from the oil system.

Figure 11:
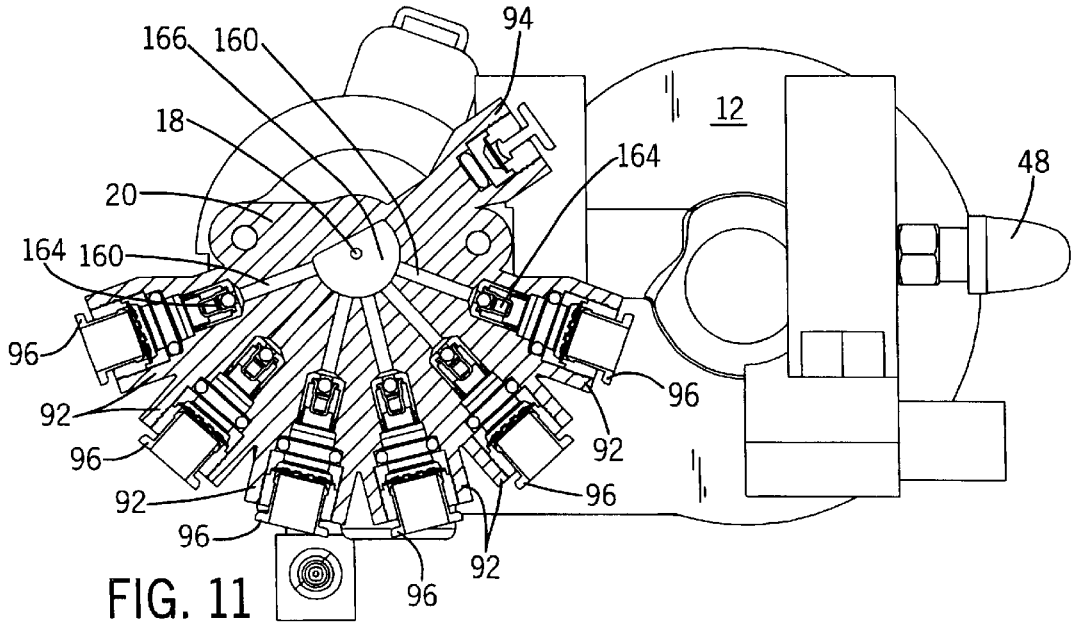
FIG. 11 is a partial cross-sectional view taken along line 11—11 of FIG. 4.

FIG. 11 shows a cross-section of the distribution manifold 20 taken along line 11—11 of FIG. 4 showing the distribution manifold mounted to the oil system housing 12. The cross-section shows oil outlet 18 opening into a D-shaped domed chamber 166 that feeds oil to each of the passages 160 equally. Each of the passages 160 include a check valve 164 within the cylinder outlet housings 92, and each of the outlet housings 92 include a push-to-connect fitting 96, such as the Legris Carstick® fitting made by Legris, Inc. Since the fuel system outlet housing 94 is at a higher elevation than the other outlet housings 92, the upper passageway is not shown. However, passageway 162 for the fuel system outlet housing 94 is at the highest elevation to intersect with a high point of the dome chamber 166. As previously described, this allows any air in the oil system to purge through outlet housing 94 which leads to the fuel system, and once in the fuel system, the air is purged through a fuel separator.

Figure 12:
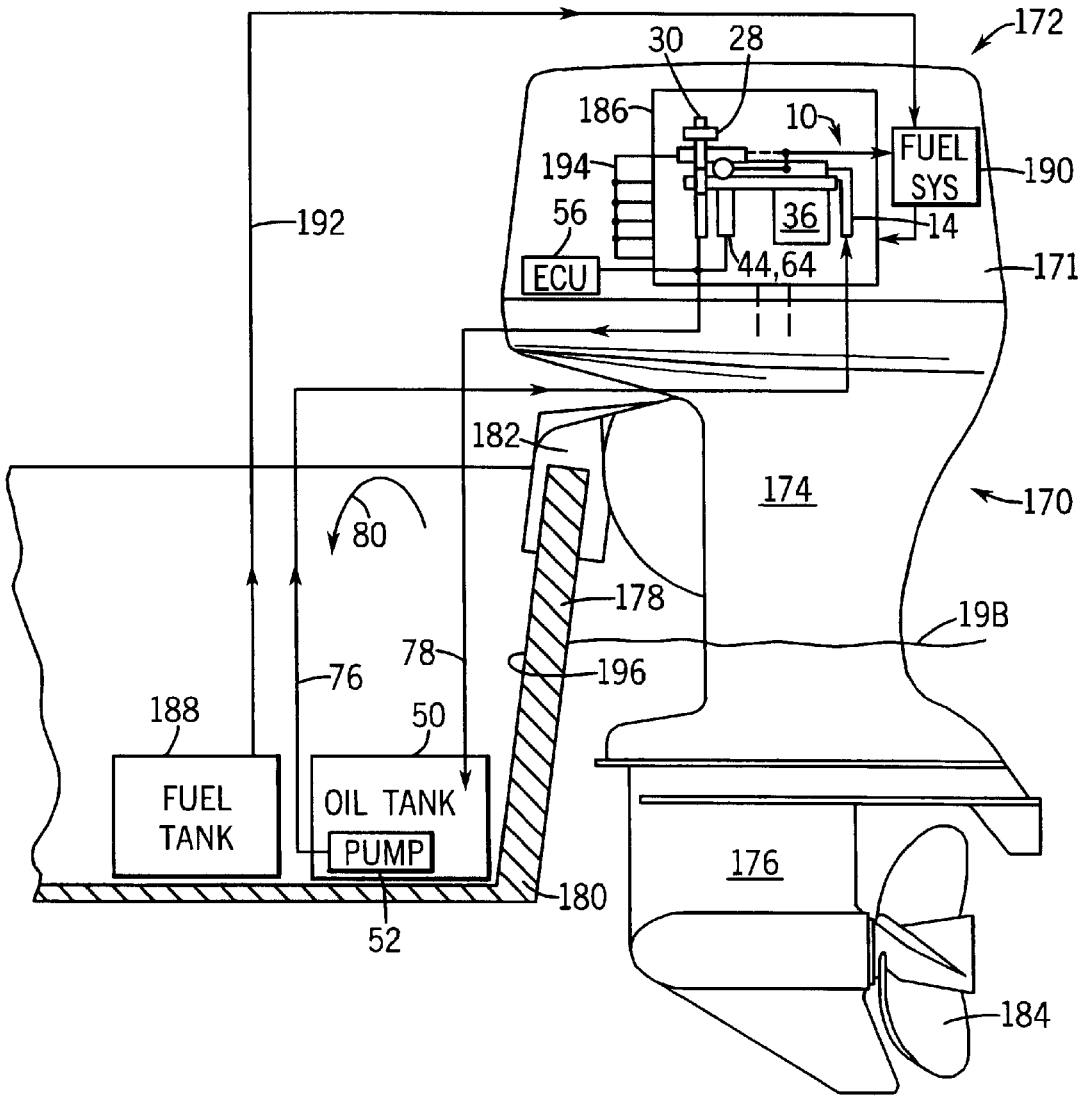
FIG. 12 is a schematical illustration of the oiling system shown in FIGS. 1–10 incorporated into an outboard motor and boat combination.

FIG. 12 shows an operating environment for the present invention herein described. However, it will be appreciated by those skilled in the art that the present invention is equally applicable for use with other types of engines and applications. FIG. 12 shows an outboard motor 170 having a power head 172 enclosed in an upper cowl 173, a mid-section 174, and a lower gear case 176. The outboard motor 170 is mounted to a transom 178 of a boat 180 by a transom mounting bracket 182. The outboard motor 170 includes a propeller 184 extending rearward from the lower gear case 176 to propel the boat 180 through the water. The powerhead 172 includes a two-stroke internal combustion engine 186 controlled by the ECU 56. A fuel tank 188 supplies fuel to the fuel system 190 through a pickup line 192, as is known.

As described with reference to FIG. 2, the oil reservoir 50 pumps oil via pump 52 to the inlet 14 and after filtering through filter 36, the oil is re-circulated through the closed loop 80 until the solenoid 44 is activated by the ECU 56 which diverts lubricant to each of the cylinders 194 and the fuel system 190. As lubricant is withdrawn and consumed from the oil reservoir 50, vent 28 cracks open to intake air and displace the oil consumed in the reservoir 50. Preferably, the oil reservoir is located in a bilge section 196 of the boat 180, which is below the water line 198. It is also preferred that the open end 30 of the vent valve 28 is at an elevation well above the water line 198 to avoid the introduction of water into the oil reservoir 50.

Figure 13:
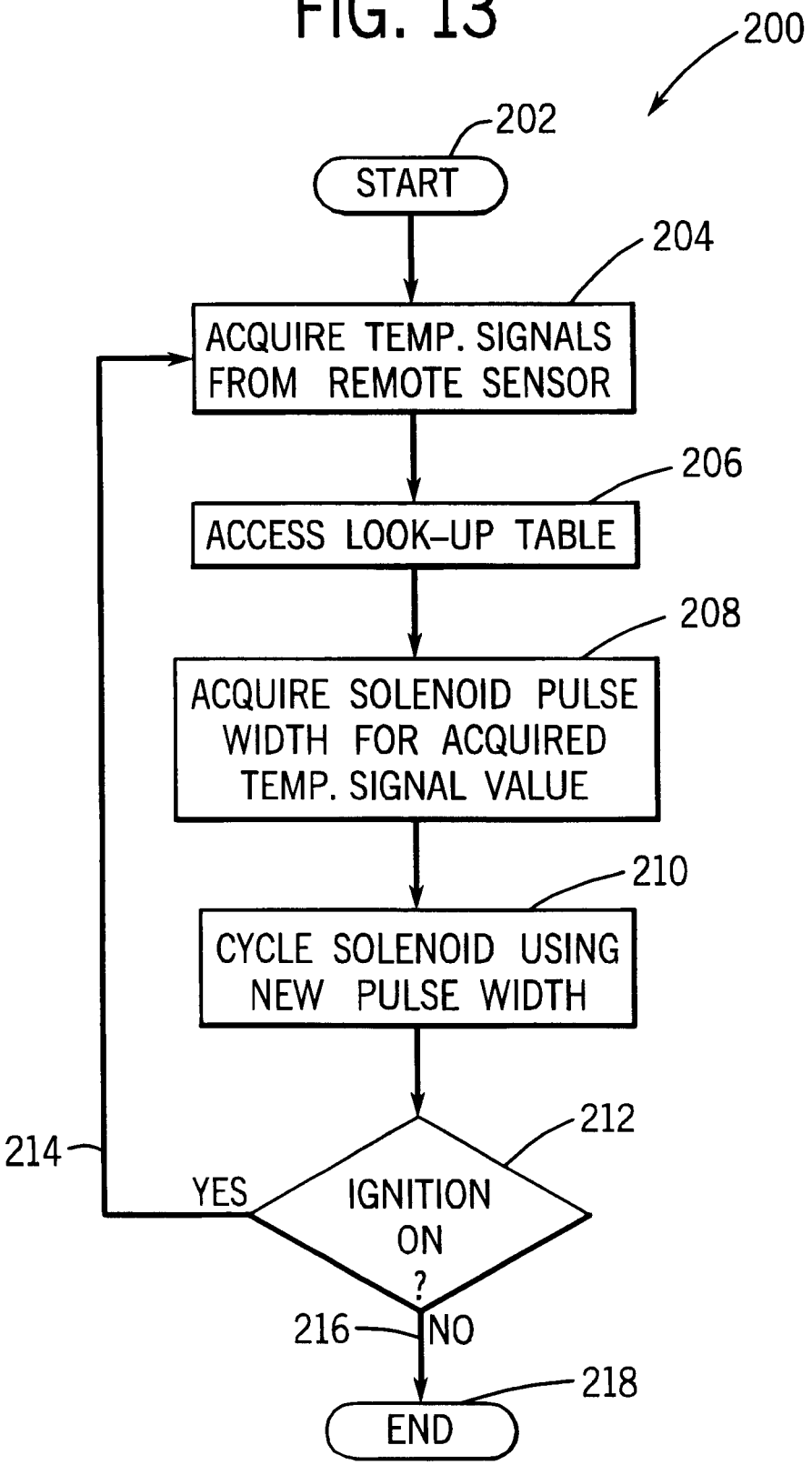
FIG. 13 is a flow chart of an oil temperature compensation control algorithm as programmed in the ECU of FIG. 2.

Referring to FIG. 13, a temperature compensation algorithm 200, as mentioned with reference to FIG. 2, is set forth. Once initialized at 202, the temperature signals are acquired from the remote sensor 204. In the ECU, a microprocessor then accesses a memory having a look-up table 206. The look-up table is developed empirically based on the location of temperature sensor 81, FIG. 2, under generalized operating conditions. A graph of oil temperature versus temperature at the remote sensor is developed and a least squares linear approximation of this data is used to develop a solenoid pulse width control signal based on the viscosity of the oil at the measured temperature. Accordingly, the appropriate solenoid pulse width is acquired at 208 and the solenoid is cycled using the new pulse width at 210. The system continues to monitor oil temperature indirectly 212, 214 until the ignition system is disabled 212, 216, at which time, the algorithm is completed 218.

Accordingly, the present invention also includes a method of providing lubricant to a two-stroke engine that includes acquiring a temperature signal, correlating the temperature signal to a viscosity of the lubricant, and then adjusting lubricant flow to the two-stroke engine based on the viscosity of the lubricant. The method also includes providing a closed loop re-circulation path for the lubricant such that when closed, no lubricant is routed to the two-stroke engine. The process periodically opens the closed loop re-circulation path to route lubricant to the engine and in order to adjust the lubricant flow, includes changing the period the closed loop is opened, changing a pulse width to control the solenoid 44 that in turn controls the oil flow control section 40. The aforementioned method and process is implemented in an apparatus through the use of a computer program stored in memory within the ECU 56 and executed by a computer, or microprocessor, in the ECU 56.

Although the preferred embodiment is described herein utilizing an indirect temperature measurement for temperature compensation control of the oil delivery system, it is contemplated and within the scope of the present invention, to include a direct measurement of the oil temperature to control the oil delivery system in response thereto. The indirect measurement proposed is preferred for hardware cost savings since an existing temperature sensor on the air intake of a fuel injected engine can be utilized.

The present invention has been described in terms of the preferred embodiment, and it is recognized that equivalents, alternatives, and modifications, aside from those expressly stated, are possible and within the scope of the appending claims.

What is claimed is:

1. A temperature compensation control for an oiling system comprising:
   - an oil injection system that periodically routes lubricant to an engine;
   - a temperature sensor to acquire an oil temperature indicative signal; and
   - a microprocessor connected to receive the oil temperature indicative signal, and in response thereto, to control the period lubricant is routed to the engine by the oil injection system.

2. The control of claim 1 further comprising a look-up table having therein data to correlate lubricant temperature from the oil temperature indicative signal.

3. The control of claim 1 wherein the temperature sensor is remote from direct contact with the lubricant.

4. The control of claim 1 wherein the oil injection system includes a closed loop re-circulation path, an oil flow control section, and a solenoid connected to the microprocessor, wherein the solenoid is mounted to control lubricant flow in the oil flow control section.

5. The control of claim 4 wherein when the solenoid is inactive, lubricant re-circulates in the closed loop re-circulation path, and when the solenoid is activated by the microprocessor, lubricant is diverted to open the closed loop re-circulation path.

6. The control of claim 5 incorporated into a two-stroke engine of an outboard motor, wherein lubricant is diverted to the two-stroke engine when the solenoid is activated by the microprocessor.

7. The control of claim 1 wherein the microprocessor creates an oil viscosity control signal based on the oil temperature indicative signal and lengthens the period lubricant is routed to the engine when lubricant temperature is low and shortens the period lubricant is routed to the engine when lubricant temperature is high.

8. The control of claim 4 wherein the microprocessor changes a pulse width of the solenoid in response to the oil temperature indicative signal.

9. The control of claim 1 incorporated into a fuel injected outboard motor and wherein the temperature sensor is an air temperature sensor located in an engine air intake.

10. The control of claim 2 incorporated into a carbureted outboard motor and wherein the temperature sensor is a thermistor located to acquire the oil temperature indicative signal, and wherein the look-up table includes pulse width data that is based on a correlation of the location of the thermistor to lubricant temperature.

11. The control of claim 1 incorporated into an outboard motor and wherein the oil injection system includes an oil reservoir located remotely from the outboard motor.

12. The control of claim 11 wherein the oil temperature indicative signal is a representation of ambient temperature.

13. A computer program that, when executed by a computer, causes the computer to:
   - periodically acquire a temperature signal indicative of lubricant temperature of an outboard motor;
   - adjust lubricant flow to an engine of the outboard motor based on lubricant viscosity as determined by the temperature signal; and
   - wherein the computer includes a memory unit having therein a look-up table with data that correlates the temperature signal to a pulse width used to control a solenoid for adjusting lubricant flow to the outboard motor.

14. The computer program of claim 13 wherein the temperature signal is indicative of ambient temperature.

15. An outboard motor comprising:

an internal combustion engine and a propulsion unit;

an oiling system for the internal combustion engine having a closed loop re-circulation system that includes a remotely located oil reservoir and an oil flow control section that periodically diverts lubricant to the internal combustion engine;

a temperature sensor to acquire a temperature signal having a relationship to a viscosity of the lubricant in the remotely located oil reservoir; and a control to receive and process the temperature signal from the temperature sensor and adjust the period that lubricant is diverted to the internal combustion engine in response to the temperature signal.

16. The outboard motor of claim 15 wherein the internal combustion engine is a two-stroke engine.

17. The outboard motor of claim 15 wherein the control includes a look-up table stored in memory to correlate the temperature signal to a pulse width control signal, and wherein the oil flow control section of the oiling system includes a solenoid that directs the diversion of lubricant in response to the pulse width control signal.

18. The outboard motor of claim 17 wherein the pulse width control signal lengthens the period the solenoid is active when the viscosity of the lubricant is high and shortens the period the solenoid is active when the viscosity of the lubricant is low.

19. A method of providing lubricant to a two-stroke engine comprising:

acquiring a temperature signal indicative of a temperature of a lubricant supply;

correlating the temperature signal to a viscosity of the lubricant;

adjusting lubricant flow to the two-stroke engine based on the viscosity of the lubricant;

providing a closed loop re-circulation path for the lubricant such that when closed, no lubricant is routed to the two-stroke engine;

periodically opening the closed loop recirculation path to route lubricant to the engine; and wherein the step of adjusting lubricant flow includes changing the period the closed loop is open.

20. A system to change lubricant flow to a two-stroke engine in an outboard motor comprising:

a means for acquiring a temperature signal indicative of a temperature of a lubricant supply;

a means for correlating the temperature signal to a viscosity of the lubricant;

a means for adjusting lubricant flow to the two-stroke engine based on the viscosity of the lubricant;

a closed loop re-circulation path for the lubricant such that when closed, no lubricant is routed to the two-stroke engine;

means for periodically opening the closed loop recirculation path to route lubricant to the engine; and wherein the means for adjusting lubricant flow includes changing the period the closed loop is open.

21. A computer program that, when executed by a computer, causes the computer to:

periodically acquire a temperature signal and correlate the temperature signal to a lubricant viscosity of a lubricant supply that is located remotely from an internal combustion engine; and adjust lubricant flow from the remotely located lubricant supply to the internal combustion engine based on lubricant viscosity as determined by the temperature signal.

22. The computer program of claim 21 wherein the temperature signal is indicative of ambient temperature.

23. The computer program of claim 21 wherein the temperature signal is indicative of oil temperature.

24. The computer program of claim 21 wherein the computer includes a memory unit having therein a look-up table with data that correlates the temperature signal to a pulse width used to control a solenoid for adjusting lubricant flow to an outboard motor.

25. A method of providing lubricant to a two-stroke engine comprising:

locating a lubricant supply remotely from the engine;

acquiring a temperature signal indicative of a temperature of the lubricant supply;

correlating the temperature signal to a viscosity of the lubricant; and adjusting lubricant flow to the two-stroke engine based on the viscosity of the lubricant.

26. A system to change lubricant flow to a two-stroke engine in an outboard motor comprising:

a means for acquiring a temperature signal indicative of a temperature of a lubricant supply that is independent of engine temperature;

a means for correlating the temperature signal to a viscosity of the lubricant; and a means for adjusting lubricant flow to the two-stroke engine based on the viscosity of the lubricant.

* * * * *